US005505819A

United States Patent [19]

De Witt et al.

[11] Patent Number: 5,505,819

[45] Date of Patent: Apr. 9, 1996

[54] NEUTRAL PAPERMAKING

[75] Inventors: James A. De Witt, Burnaby; Donald T. Eadie, North Vancouver; Gordon R. Hayes; Robert E. Monahan, both of Powell River, all of Canada

[73] Assignee: MacMillan Bloedel Limited, Vancouver, Canada

[21] Appl. No.: 220,563

[22] Filed: Mar. 31, 1994

[51] Int. Cl.[6] ..... D21H 21/06

[52] U.S. Cl. ..... 162/142; 162/147; 162/168.3; 162/181.1; 162/181.2; 162/183; 162/190; 162/198; 162/DIG. 11

[58] Field of Search ..... 162/181.1, 181.2, 162/183, 190, 142, 198, 168.3, 147, DIG. 11, 150

[56] References Cited

U.S. PATENT DOCUMENTS

| | | | |
|---|---|---|---|
| 4,470,877 | 9/1984 | Johnstone et al. | 162/183 |
| 4,913,775 | 4/1990 | Langley et al. | 162/183 |
| 5,126,014 | 6/1992 | Chung | 162/183 |
| 5,156,719 | 10/1992 | Passaretti | 162/181.2 |
| 5,234,548 | 8/1993 | Hatton | 162/183 |
| 5,378,322 | 1/1995 | Hornsey | 162/181.2 |

*Primary Examiner*—Peter Chin
*Attorney, Agent, or Firm*—C. A. Rowley

[57] ABSTRACT

A pulp furnish containing predominantly wood-containing fibers (mechanical) and natural calcium carbonate as a filler is formed into a paper in a paper forming section of a paper machine at a neutral pH in the range of 6.7 to 7.5. Bentonite plus a suitable polymer such as a polyacrylamide produces a pulp stock that has exceptionally high drainage characteristics particularly when used with chalk as the filler. The pH of the stock in the headbox is maintained at the desired level of pH 6.7–7.3 by monitoring the pH in the headbox and adjusting the flow of pH reducing and buffering agent, preferably phosphoric acid, into the pulp prior to the headbox to obtain the desired pH in the stock.

8 Claims, 1 Drawing Sheet

NEUTRAL PAPERMAKING

FIELD OF THE INVENTION

The present invention relates to the formation of the paper web using neutral pH forming conditions and wherein calcium carbonate is used as the principal filler.

BACKGROUND OF THE PRESENT INVENTION

It is known to manufacture paper by supplying the papermaking stock to the forming section of a paper machine under acid, neutral or alkaline conditions. Alkaline conditions are primarily used with a wood free fiber and at a pH in the range of about 8 whereas in acid papermaking from wood containing stock, the pH is generally well below 7 and normally in the order of 4 to 6. Neutral papermaking is usually carried out at pH of about 6.8 to 7.5.

One of the major advantages of alkaline papermaking is that it permits the use of calcium carbonate which is a relatively inexpensive filler in relatively large quantities in the paper. Calcium carbonate is generally less expensive than wood fiber and has a relatively high brightness which thus facilitates the production of low cost priming papers.

Attempts have been made to utilize calcium carbonate filler with acid papermaking and/or neutral papermaking by means of specific acid tolerant carbonates which are specially prepared, for example, by the addition of phosphorus compounds to the surface of the carbonate to stabilize the carbonate under acid conditions. It is also known when using such acid tolerant carbonates to operate the paper machine at pH generally below 7 (i.e. mild acid conditions) and to use phosphoric acid to maintain the pH of the stock.

Chalk has been used as a filler in paper.

BRIEF DESCRIPTION OF THE PRESENT INVENTION

It is an object of the present invention to provide a process for making paper under neutral papermaking conditions while incorporating natural calcium carbonate filler into the furnish.

Broadly, the present invention relates to a method of making paper from a furnish containing predominantly mechanical pulp under substantially neutral conditions comprising adding natural calcium carbonate to a mechanical pulp stock being fed to a headbox of a forming section of a paper machine, adding bentonite and a suitable polymer to said stock, controllably adding a pH reducing and buffering agent to said stock being fed to said headbox to maintain the pH of said pulp stock in said headbox within the range of 6.7 and 7.5, forming a sheet by separating white water containing calcium carbonate from the pulp stock in said forming section, recirculating said white water containing calcium carbonate to said headbox with said pulp stock.

Preferably said polymer comprises a polyacrylamide polymer

Preferably said pH reducing and buffering agent will comprise phosphoric acid.

Preferably, the form of said natural calcium carbonate will be chalk.

Preferably, the pH of said stock in the headbox will be sensed and addition of phosphoric acid to maintain said pH in said range of 6.7 to 7.5 controlled based on said pH sensed in said headbox.

Preferably said pH range will be 6.9 to 7.4

BRIEF DESCRIPTION OF THE DRAWINGS

Further features, objects and advantages will be evident from the following detailed description of the preferred embodiments of the present invention taken in conjunction with the accompanying drawing in which.

DESCRIPTION OF THE PREFERRED EMBODIMENTS

Figure 1:
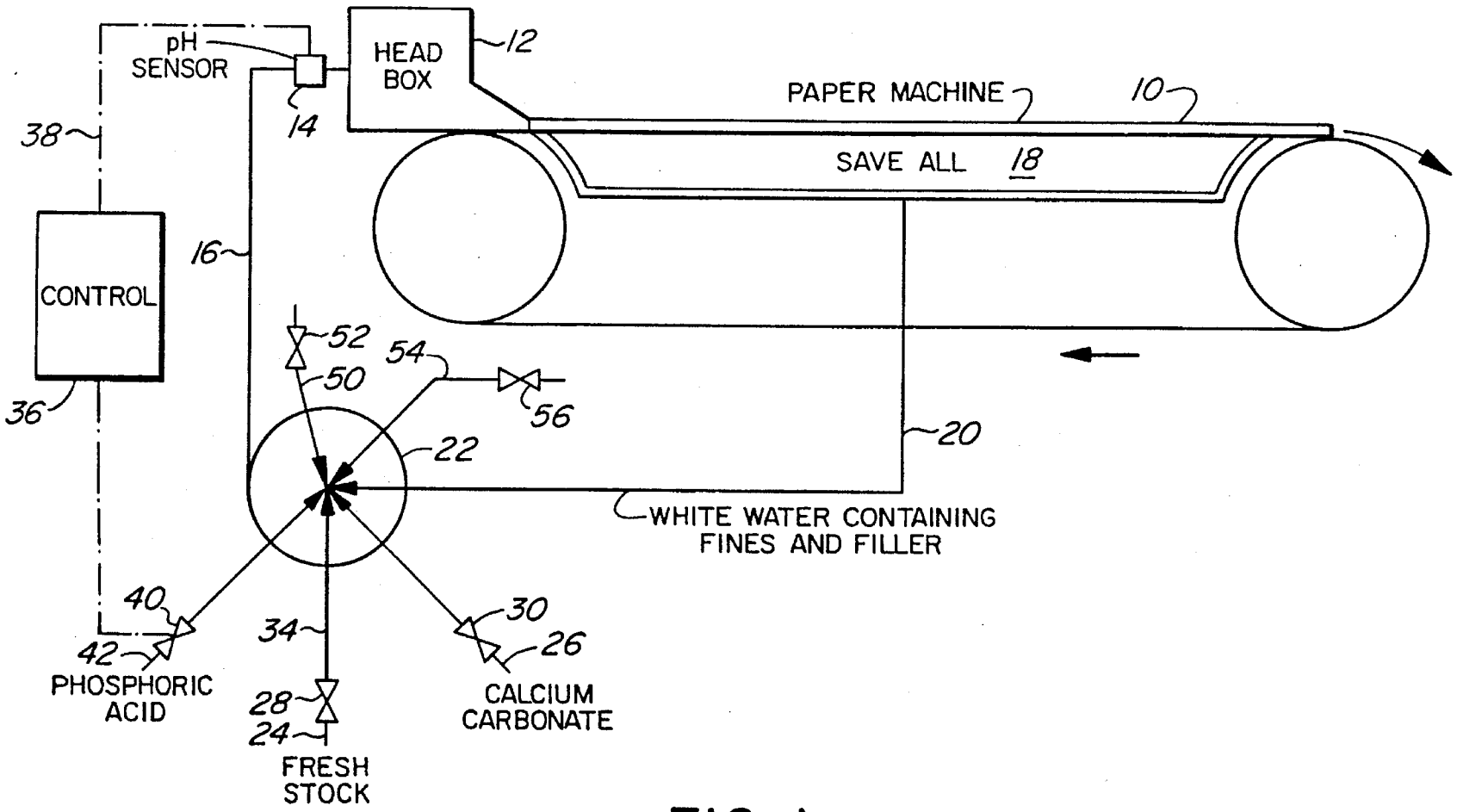
FIG. 1 is a schematic flow diagram for a paper machine incorporating the present invention.

The term calcium carbonate has been used in relation to the present to describe natural calcium carbonate as opposed to and to distinguish from precipitated calcium carbonate which has not been found to be satisfactory for practising the present invention.

As illustrated in FIG. 1, the system includes a paper machine 10 which could be any suitable type of paper machine including twin wire former, etc. The stock to be formed into paper is delivered to the headbox 12 via line 16 and the pH of the stock preferably is measured in the line 16 via sensor 14. The stock is directed from the headbox 12 into the forming section of the papermaking machine 10 to form a sheet by drainage of white water from the stock. This drained white water is collected in the save-all 18 and in the illustrated arrangement, is conducted via line 20 to the inlet of the fan pump 22 where it is mixed with fresh stock from line 24 and pumped through line 16 to the headbox 12. The fresh stock in line 24 may be mixed with the white water in line 20 either before or in the fan pump 22.

Filler material may be added as indicated by line 26 at the inlet side of the fan pump. The fresh stock flow through line 24 is controlled via valve 28 and the amount of filler added is controlled via valve 30. The amount of filler applied will be the normal amount of filler applied, e.g. when calcium carbonate is used the filler added will be in the range of 2 to 30% based on the dry weight of the fibers.

It has been found that, if the calcium carbonate filler is used the drainage characteristics of the stock in the forming and press sections of the paper machine are unexpectedly improved (pulp drains faster) to provide in the order of about a 1% increase in solids measured in the press section of the paper machine as compared to when clay fillers are used. This advantage is particularly pronounced when the calcium carbonate is in the form of chalk. The higher drainage rate permits higher production and/or a reduction in the amount of drier energy applied to the sheet per unit time and/or the ability to produce heavier basis weight paper without the normal corresponding speed reduction.

It will be apparent that the addition of calcium carbonate will drive the pH of the stock into the alkaline range. When practising the present invention the pH of the stock is maintained substantially neutral, i.e. in the range of about 6.7 to 7.5 to avoid detrimental effects of a high pH on the paper being produced.

The pH of the in-coming stock mixture in the line 16 is sensed by the sensor 14 which feeds this information to the control system 36 via line 38. The control system 36 controls the valve 40 in the acid delivery line 42 to adjust the amount of acid added to the pulp stock being fed to the headbox 12 to maintain the pH in the headbox 12 in the specified range of 6.7 to 7.5.

Fines and calcium carbonate filler are present in the recirculated white water in line 20 and fresh calcium carbonate filler is added via line 26. The calcium carbonate filler tends to increase the pH in the headbox 12. Care must be taken to maintain the pH reasonably constant even though there may well be fluctuations in the amount of calcium carbonate filler in the line 16.

It was expected that substantially any acid could be used to control (lower) the pH as required. However, applicant has found, particularly, when the calcium carbonate filler used is chalk, that phosphoric acid has an excellent buffering effect, so that normal fluctuations in the ratio of acid to alkali in the stock entering the headbox 12 do not significantly change the pH of the stock over the operating range i.e. minor fluctuations in the amount of filler do not significantly alter the pH.

It has been found in simple experiments using a closed system that the calcium carbonate filler (specifically chalk) and phosphoric acid reach an equilibrium condition wherein no further chalk is consumed and that when additional chalk is added to the system only a minor amount of additional phosphoric acid need be added to attain the equilibrium condition and hold the pH at its desired value. When alum, which is commonly used for this purpose in commercial operations operated in the pH range of 6.9 to 7.3, was used in place of phosphoric acid a deposit formed and an equilibrium was not reached.

In laboratory trials using phosphoric acid it was found that the amount of chalk retained in the sheet was higher for a given amount of chalk filler added to the sheet at a given target pH than when alum was used to control pH.

When phosphoric acid and calcium carbonate filler are used, the calcium carbonate filler in recirculated white water is significantly more stable than when alum is used in place of the phosphoric acid.

Applicant has also found that producing printing paper from mechanical pulp using chalk as the filler at a neutral pH wherein the system is held at the neutral pH by the addition of phosphoric acid, the resultant pulp had a substantially increased stability with respect to thermal brightness reversion. Specifically, a paper with about a one point higher brightness could be delivered to a press room using the same manufacturing brightness target at the paper machine when the neutral process of the present invention was used as opposed to paper made with conventional acid paper making process.

Bentonite (normally in slurry form) is preferably added to the stock as indicated by line 50 in an amount controlled via the valve 52. When bentonite is used, it is important to add a suitable selected polymer to the stock as indicated by line 54. The amount of polymer is controlled by control valve 56. The use of the polymer in combination with the bentonite better ensure retention of the carbonate filler.

A suitable polymer for addition with the bentonite is a polyacrylamide for example Percol 455 or Organopol 21 sold by Allied Colloids Inc.

The amount of bentonite applied will normally be in the range of 0.05 to 0.7% based on the weight of the pulp fibers, preferably 0.15 to 0.5% of the pulp fibers. The polymer will normally be added in the range of 0.001 to 0.1% by weight of the pulp fibers, preferably 0.003 to 0.08% of the pulp fibers.

It has been found that if a bentonite (and the polymer) is added to the stock, the drainage characteristics of the pulp are unexpectedly improved by an amount similar to the improvement found when the calcium carbonate filler is chalk, i.e. a further about 1% increase in solids is obtained in the press section.

When chalk and bentonite (plus polymer) are both used they seem to generate a synergic effect in that the drainage rate increases beyond what would be expected by using these two materials in combination.

EXAMPLES

Example 1

In laboratory experiments, acid was added over time to chalk containing furnish to maintain the pH at 6.9. In a first system where alum was used as the acid to reduce the pH, all of the chalk was eventually consumed. In a second system where phosphoric acid was used, the chalk and phosphoric acid came to an equilibrium with much of the chalk remaining.

To test the effect of increased chalk in these systems, the amount of chalk in each system was doubled which required an additional 71% of the initial amount of alum to reduce the pH to 6.9 in the first system while only a further amount equal to 7% of the initial quality of phosphoric acid was required to stabilize the pH at the desired level in the second system.

A third amount of chalk equal to the initial amount was added to each of the systems. In this case, no further acid was needed to buffer the pH in the phosphoric acid system.

In all of the alum experiments, scum deposit was formed.

Example 2

In recirculating experiments, significantly more chalk was retained in the sheet when phosphoric acid was used to control pH as opposed to alum. On average, 6.7% chalk was retained when phosphoric acid was used while with alum, only 5.43% chalk was retained (for a 12% loading of chalk based on fiber).

Example 3

Laboratory tests were conducted by producing 60 gram/square meter ($m^2$) handsheets (10 per set) from a softwood pulp containing 15% semibleached kraft and 85% $H_2O_2$ brightened mechanical pulp (7% thermomechanical (CTMP)/93% groundwood (GWD)). For each test, 10% filler was added based on the dry weight of the fibers, the handsheets produced were pressed on the Durand Press and tested for solids contents. The results obtained are shown in Table 1 as follows

TABLE 1

| 1 Clay Per. | Clay Per. Ben. | 2 Clay Org. Ben. | 3 4 Chalk Per. | Chalk Per. Ben. | 5 Chalk Org. Ben. | 6 |
|---|---|---|---|---|---|---|
| solids % ± | 42.51 0.38 | 43.06 0.65 | 43.32 0.49 | 43.33 0.31 | 43.76 0.41 | 44.13 0.29 |

where

Per.= Percol 455

Org.= Organopol 21

Ben.= Bentonite

On analysis using the Student t-test it was determined that at the 95% confidence level there is no significant difference between 2, 3 or 4 and between 3 and 5 in all other cases there are significant differences.

A significant advantage is shown when chalk, a polymer (a polyacrylamide namely, Percol 455 or Organopol 21) and bentonite are used in combination in the furnish as the drainage is improved over any of the other combinations including simply replacing the chalk with clay.

Example 4

On-machine trials were conducted using a furnish of 23% semibleached kraft and 72% mechanical pulp together with 5% deinked fibers on a Black Clawson Vertiformer having a 3 nip press section operating at 2000 feet/minute to produce 52 gram high brightness newsprint. Chalk was added to obtain 5% chalk retained in the sheet. To obtain this, the added chalk approached about 6%.

With the particular machine used, stock flow was about 2,000 U.S. gallons per minute and returned dilution water (recirculated white water) constituted about 7500 U.S. gallons per minute at a consistency of about 0.29% which produced the headbox flow in the order of 9400 U.S. gallons per minute at a consistency of 0.83%.

The solids composition of the internal loop or white water included filler, fines, and a minor amount of clay from the deinked fiber.

A 75% phosphoric acid solution was added to the flow approaching the headbox in an amount of between 1.6 and 3.9 liters per ton of pulp to maintain the pH of the headbox between 6.9 and 7.3.

Under the above conditions, it was found that control of pH could easily be maintained within the range of + 0.1 pH units and that operation was stable.

It was found that the use of chalk increased the third press paper solids by 1% compared with similar paper manufactured with calcined clay, i.e. wherein the process was repeated but instead of using chalk as the filler, calcined clay was the filler.

In a specific set of tests, the paper machine was run with chalk or clay filler using a retention aid comprised of polyacrylamide with and without bentonite as a second component. The filler level (chalk or clay) in all sheets was set at 3.3% (a base load of 0.6% chalk filler was loaded into the clay filled sheets).

The amount of polyacrylamide used in each of the test when no bentonite was added was 0.022% based on the weight of the pulp fibers and when used with bentonite 0.017% based on the dry weight of the fibers. Bentonite when used was used in the amount of 0.3% based on the dry weight of the fibers.

The results obtained are indicated at Table II.

TABLE II

| Additives | Chalk Poly-acrylamide | Clay Poly-acrylamide | Chalk Poly-acrylamide Bentonite | Clay Poly-acrylamide Bentonite |
|---|---|---|---|---|
| Press solids, % | 40.0 | 41.0 | 41.0 | 42.2 |

It was apparent that the use of chalk and polyacrylamide produced a 1% increased in press solids and that when bentonite was added, the chalk, polyacrylamide and bentonite containing slurry resulted in pressed solids in the order of 42.2%, i.e. a better than 1% increase in solids over that obtained with chalk and polyacrylamide and that obtained with clay, polyacrylamide and bentonite. The addition of bentonite to the clay containing stock also increased the press solids by 1% measured at the third press relative to the same stock but without the bentonite.

To put these results in perspective, a 1% increase in sheet solids leaving the press generally permits a 3–5% increase in production rate or a comparable decrease in the energy consumed during drying. It will be apparent that the combined effects of chalk and bentonite are more than additive in that better than a 2% increase in press solids is obtained. This increase in solids should permit an increase of production rate of better than 6% over a conventional clay polyacrylamide system.

Having described the invention, modifications will be evident to those skilled in the art without departing from the scope of the invention as defined in the appended claims.

We claim:

1. A method of making paper from a furnish containing predominantly mechanical pulp under substantially neutral pH papermaking conditions comprising adding a filler consisting essentially of natural calcium carbonate to a mechanical pulp stock being fed to a headbox of a forming section of a paper machine, adding to said pulp stock being fed to said headbox at least 0.05% bentonite based on the dry weight of said pulp and at least 0.001% by weight based on the weight of said pulp of a polymer that co-operates with said bentonite to provide an improved retention aid for said natural calcium carbonate filler, controllably adding a pH reducing and buffering agent consisting essentially of phosphoric acid to said pulp stock being fed to said headbox in an amount to maintain the pH of said pulp stock in said headbox within the range of between 6.7 and 7.5, forming a sheet by separating white water containing some of said natural calcium carbonate from the pulp stock in said forming section and recirculating said white water containing said natural calcium carbonate to said headbox with said pulp stock being fed to said headbox.

2. A method as defined in claim 1 wherein said polymer comprises a polyacrylamide.

3. A method as defined in claim 1 wherein said natural calcium carbonate is chalk.

4. A method as defined in claim 2 wherein said natural calcium carbonate is chalk.

5. A method as defined in claim 1 further comprise sensing the pH of said stock in the headbox and controlling addition of said phosphoric acid to said stock to maintain said pH in said range of 6.7 to 7.5 based on said pH sensed in said headbox.

6. A method as defined in claim 2 further comprise sensing the pH of the stock in the headbox and controlling addition of said phosphoric acid to said stock to maintain said pH in said range of 6.7 to 7.5 based on said pH sensed in said headbox.

7. A method as defined in claim 3 further comprise sensing the pH of the stock in the headbox and controlling addition of said phosphoric acid to said stock to maintain said pH in said range of 6.7 to 7.5 based on stud pH sensed in said headbox.

8. A method as defined in claim 4 further comprise sensing the pH of the stock in the headbox and controlling addition of said phosphoric acid to said stock to maintain said pH in said range of 6.7 to 7.5 based on stud pH sensed in said headbox.

* * * * *

UNITED STATES PATENT AND TRADEMARK OFFICE

CERTIFICATE OF CORRECTION

PATENT NO. : 5,505,819

DATED : April 9, 1996

INVENTOR(S) : James A. De Witt, Donald T. Eadie, Gordon R. Hayes, Robert E. Monahan It is certified that error appears in the above-indentified patent and that said Letters Patent is hereby corrected as shown below:

Column 5 line 50, should read

TABLE II

| Additives | Clay Poly-acrylamide | Chalk Poly-acrylamide | Clay Poly-acrylamide Bentonite | Chalk Poly-acrylamide Bentonite |
|---|---|---|---|---|
| Press solids, % | 40.0 | 41.0 | 41.0 | 42.2 |

Signed and Sealed this

Twentieth Day of August, 1996

Bruce Lehman

BRUCE LEHMAN

*Commissioner of Patents and Trademarks*

*Attest:*

*Attesting Officer*